United States Patent [19]

Nagasaki et al.

[11] Patent Number: 4,884,812

[45] Date of Patent: Dec. 5, 1989

[54] GOLF CLUB HEAD

[75] Inventors: Yoichi Nagasaki; Itsushi Nagamoto; Toyohiko Tadokoro; Masaki Fujimura, all of Hamamatsu, Japan

[73] Assignee: Yamaha Corporation, Japan

[21] Appl. No.: 255,590

[22] Filed: Oct. 11, 1988

Related U.S. Application Data

[62] Division of Ser. No. 821,029, Jan. 21, 1986, Pat. No. 4,798,383.

[30] Foreign Application Priority Data

Jan. 29, 1985 [JP] Japan ..... 60-015145
Sep. 9, 1985 [JP] Japan ..... 60-199034
Sep. 27, 1985 [JP] Japan ..... 60-214297

[51] Int. Cl.[4] ..... A63B 53/04

[52] U.S. Cl. ..... 273/167 H; 273/169; 273/173; 273/78

[58] Field of Search ..... 273/173, 174, 169, 167 H, 273/170, 171, 172, 167 F, 167 K, 167 J, 78

[56] References Cited

U.S. PATENT DOCUMENTS 632,885 9/1899 Sweny ..... 273/78
699,624 5/1902 Kempshall ..... 273/78
1,678,637 7/1928 Drevitson ..... 273/169
2,034,936 3/1936 Barnhart ..... 273/173
2,447,967 8/1948 Stone ..... 273/169
2,846,228 8/1958 Reach ..... 273/169
3,218,072 11/1965 Burr ..... 273/173
3,847,399 11/1974 Raymont ..... 273/169
3,975,023 8/1976 Ihamori ..... 273/173
4,618,149 10/1986 Maxel ..... 273/167 H
4,653,756 3/1987 Sato ..... 273/169

FOREIGN PATENT DOCUMENTS 9862 9/1906 United Kingdom ..... 273/78
1201648 8/1970 United Kingdom ..... 273/78

*Primary Examiner*—George J. Marlo
*Attorney, Agent, or Firm*—Lerner, David, Littenberg Krumholz & Mentlik

[57] ABSTRACT

In constructioln of a golf club head, presence of a light FRP plate located in a through opening in the face side region allows free weight assignment to other regions for ideal inertia moment adjustment. A metal layer may be provided on the FRP plate to produce a locally laminated face side construction in which thickness ratio of components can be adjusted for better feel at shooting.

2 Claims, 5 Drawing Sheets

GOLF CLUB HEAD

This is a division of application Ser. No. 821,029, filed Jan. 21, 1986 now U.S. Pat. No. 4,798,383.

BACKGROUND OF THE INVENTION

The present invention relates to an improved golf club head, and more particularly relates to improvement in shot of balls by a golf club head containing a fiber reinforced plastic (FRP) element.

Although the following descriptions are directed to iron golf club heads, the present invention is well applicable to wooden golf club head also as evidenced by an example later.

One typical example of the conventional iron golf club head has a main body made of stainless steel, cast iron or brass. Another conventional iron golf club head has a main body which is made up of a metallic core, a metallic sole section and FRP shell covering the core and the face side section. In particular, an iron golf club head with a CFRP (carbon fiber reinforced plastics) shell now wins much attention of golf players.

Since the face side surface is provided by highly elastic CFRP shell, the iron golf club head of this type assures significantly long shot of balls, reduced weight of the head and correct shot in the intended direction.

When wholly made of metal, such a golf club head cannot assure ideal feel at shot. In addition, no local weight adjustment can be effected inasmuch as the main body is made of a sole material of uniform specific gravity. This disenables free inertia moment adjustment of the golf club head.

When FRP shell is employed, the face side surface provided by a CFRP shell is rather vulnerable to damage. Combination of a heavy core with a light shell again does not allow easy and free inertia moment adjustment. Further, since the metallic core is present behind the CFRP providing the face side surface, characteristics of the CFRP is subdued by influence of characteristics of the metallic material.

SUMMARY OF THE INVENTION

It is one object of the present invention to assure ideal feel at shot of balls by a golf club head.

It is another object of the present invention to enable free and easy inertia moment adjustment on a golf club head.

It is a further object of the present invention to develop, in a golf club head containing a FRP element, functional advantages of the FRP element as much as possible.

In accordance with the basic concept of the present invention, a main body has a face side surface for shooting balls and a FRP plate is arranged in the face side region of the main body substantially in parallel to the face side surface.

DESCRIPTION OF THE PREFERRED EMBODIMENTS

Figure 1:
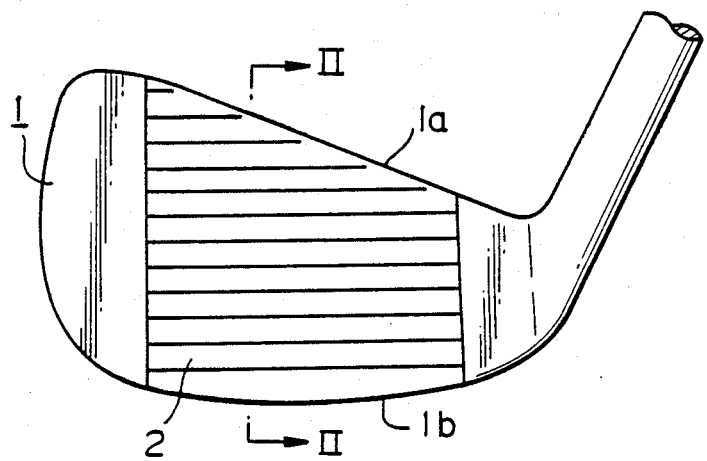
FIG. 1 is a front view of one embodiment of the golf club head in accordance with the present invention.

In the following description, substantially like elements in different embodiments are indicated with like reference numerals.

Figure 2:
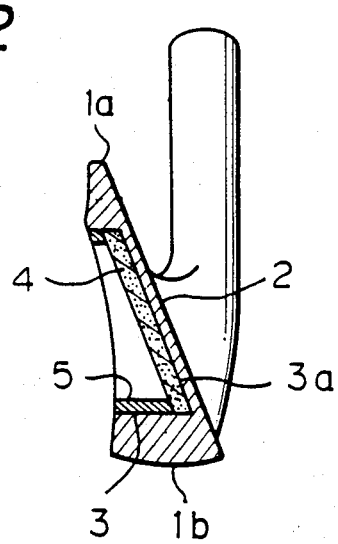
FIG. 2 is a section taken along the line II—II in FIG. 1.
Figure 3:
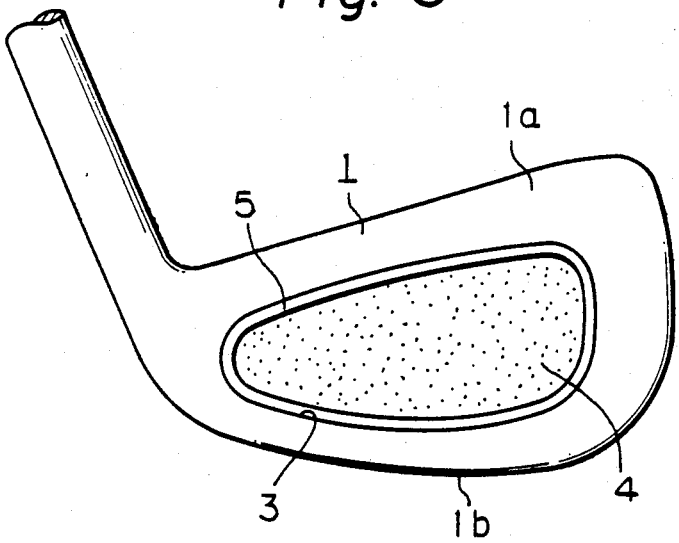
FIG. 3 is a rear view of the golf club head shown in FIG. 1.

The first embodiment of the golf club head in accordance with the present invention is shown in FIGS. 1 to 3. In the case of this embodiment, the main body of the golf club head is made of metal and has a face side section providing the face side surface and a FRP plate is attached to the rear side of the face side section of the main body.

More specifically in FIG. 1, the golf club head includes a metallic main body 1 having a face side section 2 providing the face side surface for shooting balls. On the rear side of the face side section 2, is a local gouge 3 is formed between the upper and lower edges 1*a*, 1*b* of the main body 1 whilst opening rearwards. A FRP plate 4 is inserted into the gouge 3 and tightly attached to the flat end wall 3*a* of the gouge 3 to form a locally laminated face side construction. A configurated frame or ring 5 is also force inserted into and bonded to the gouge 3 in order to press the FRP plate 4 tightly against the rear side of the face side section 2, i.e. the end wall 3*a* of the gouge 3.

The thickness of the face side section 2 of the main body 1 should preferably be in a range from 0.5 to 3.0 mm. Whereas the thickness of the FRP plate 4 should preferably be in a range from 1.0 to 5.0 mm.

Weight reduced in the face side region by addition of the light FRP plate may be assigned to other region or regions of the main body 1 such as the sole side and back side section. Such possibility of weight assignment enables free and ideal inertia moment adjustment of the golf club head.

The FRP plate 4 is prepared in reference to the amount of weight to be reduced in the face side region for inertia moment adjustment. In one example, a plurality of sheets of reinforcing fibers are combined in layers and the layered combination is impregnated with matrix bath of synthetic resins such as epoxy resin and unsaturated epoxy resin for subsequent hardening. In an alternative, thin hardened FRP plates may be combined in piles.

Reinforcing fibers are used in two or three dimensional woven or nitted masses. The masses may take the form of cloths, combinations of cloths with rovings, mats or mats combined with cloths.

Carbon fibers are typically used for reinforcement. In combination with carbon fibers as the major component, at least one of aromatic polyamide fibers, glass fibers, boron fibers, silicon carbide fibers and alumina fibers may be advantageously used for reinforcement. Further, fiber reinforced metal may be used for this purpose in which metal works as a matrix.

By thickness ratio adjustment in the locally laminated face side construction of the main body, feel at shot of balls can be subtly adjusted. Weight assignment from the face side region allows free and ideal inertia moment adjustment on the golf club head. The metallic face side surface well endured any sorts of damages.

The second embodiments of the golf club head in accordance with the present invention are shown in FIGS. 4 to 9. In the case of this embodiment, the main body has a gouge formed therethrough in the shooting direction, i.e. a direction substantially normal to the face side surface, and a FRP plate closes the face side opening of the gouge in the main body.

Figure 4:
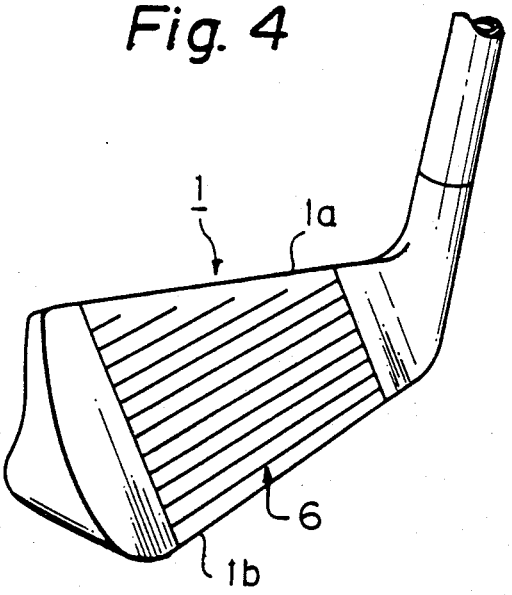
FIG. 4 is a perspective view of another embodiment of the golf club head in accordance with the present invention.
Figure 5:
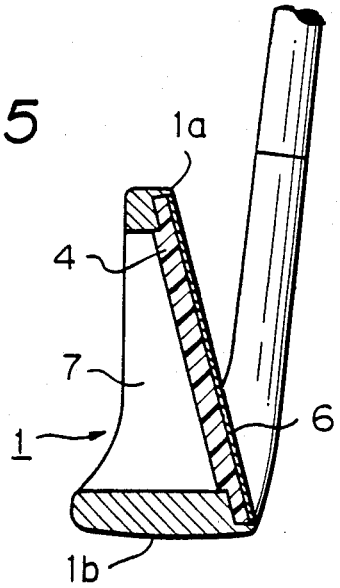
FIG. 5 is a side sectional view, partly in section, of the golf club head shown in FIG. 4.
Figure 6:
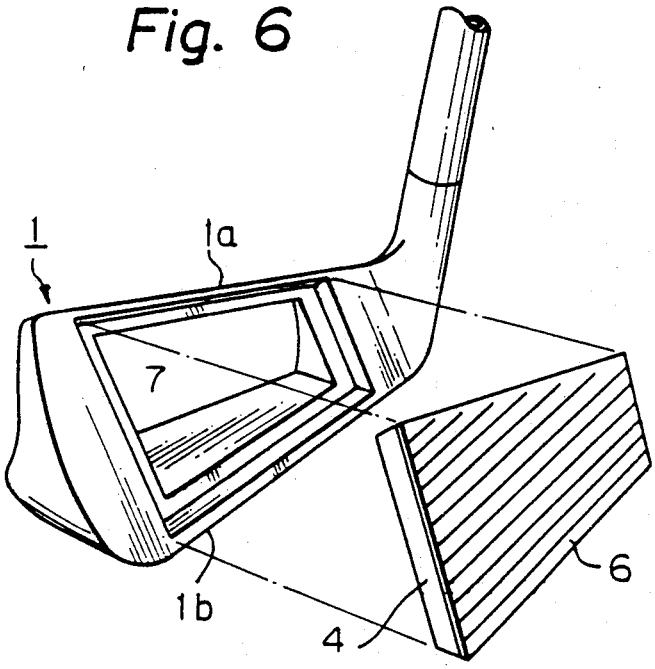
FIG. 6 is a perspective view of the golf club head shown in FIG. 4, in a disassembled state.

More specifically in FIGS. 4 to 6, a gouge 7 is formed through the main body 1 between the upper and lower edges 1*a*, 1*b* and its face side opening is closed by a FRP plate 4. The front surface of the FRP plate 4 is plated with a metal layer 6.

Figure 7:
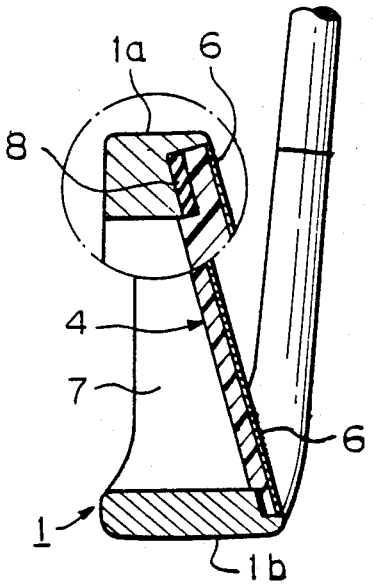
FIG. 7 is a side view, partly in section and enlarged, of a further embodiment of the golf club head in accordance with the present invention.

A modification is shown in FIG. 7, in which an elastic member 8 is interposed between the main body 1 and the FRP plate 4. Presence of such an elastic member 8 well promotes transmission of knetic energy from the highly elastic golf club head to a lowly elastic ball at shooting balls.

Figure 8:
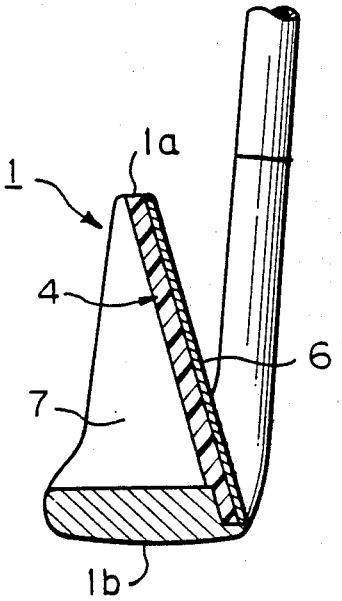
FIG. 8 is a side view, partly in section, of a still further embodiment of the golf club head in accordance with the present invention.

Another modification is shown in FIG. 8, in which the gouge 7 opens upwards too.

Figure 9:
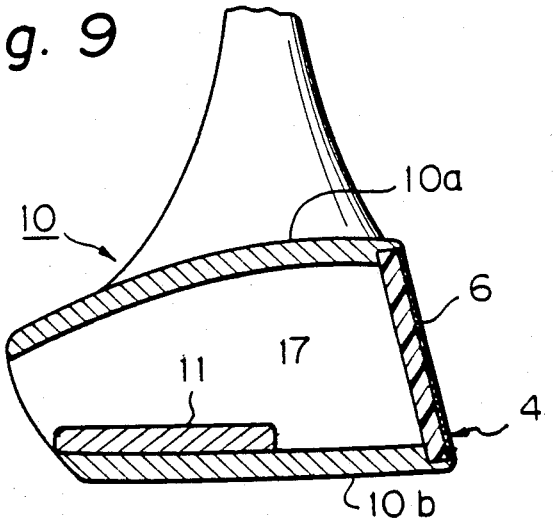
FIG. 9 is a side view, partly in section, of a still further embodiment of the golf club head in accordance with the present invention.

As briefly mentioned already, the present invention is well applicable to a wooden golf club head also. One example is shown in FIG. 9, in which a main body 10 is provided with a gouge 17 formed therethrough and its face side opening is closed by a FRP plate 4 accompanied with a metal layer 6. A weight 11 may be arranged in the gouge 17 for adjustment in position of the center of gravity.

Figure 10:
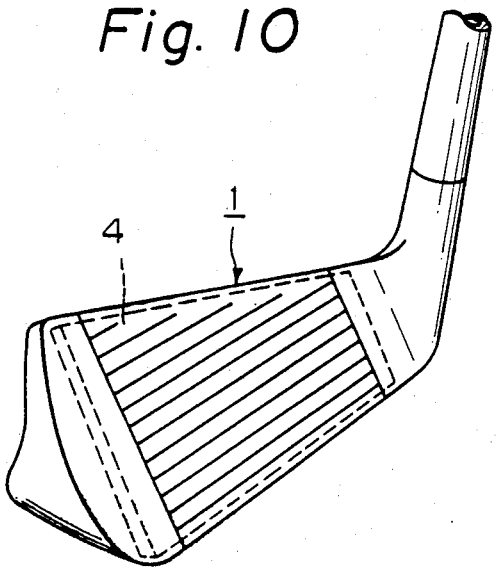
FIG. 10 is a perspective view of a still further embodiment of the golf club head in accordance with the present inventio.
Figure 11:
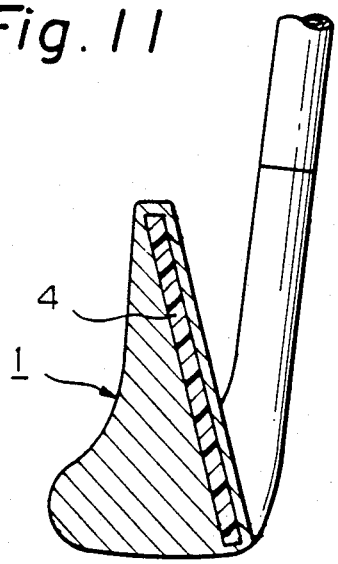
FIG. 11 is a side view, partly in section, of the golf club head shown in FIG. 10.

The third embodiment of the golf club head in accordance with the present invention is shown in FIGS. 10 and 11, in which a FRP plate is fully embedded in the main body 1 near the face side surface.

We claim:

1. An improved golf club head comprising:

a main body having a face side surface for shooting balls, said main body having an opening therethrough in the shooting direction, and a FRP plate arranged in the face side region of said main body substantially parallel to said face side surface, said FRP plate having a thickness less than the depth of said opening and closing said opening on the face side of said main body.

2. An improved golf club head as claimed in claim 1 in which the front surface of said FRP plate is covered with a metal layer.

* * * * *